US006140036A

United States Patent [19]

Parton et al.

[11] Patent Number: 6,140,036

[45] **Date of Patent: *Oct. 31, 2000**

[54] PHOTOGRAPHIC MATERIAL HAVING IMPROVED COLOR REPRODUCTION

[75] Inventors: Richard L. Parton, Webster; Steven G. Link, Rochester; Joan C. Potenza, Rush; Lois A. Buitano, Rochester, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/259,992

[22] Filed: Mar. 1, 1999

[51] Int. Cl.[7] ..... G03C 1/14; G03C 1/18

[52] U.S. Cl. ..... 430/583; 430/585

[58] Field of Search ..... 430/583, 585

[56] References Cited

U.S. PATENT DOCUMENTS

| | | | |
|---|---|---|---|
| 4,889,796 | 12/1989 | Ikegawa et al. . | |
| 4,970,141 | 11/1990 | Ikegawa et al. . | |
| 5,198,332 | 3/1993 | Ikegawa et al. . | |
| 5,316,904 | 5/1994 | Parton et al. . | |
| 5,523,203 | 6/1996 | Nishigaki . | |
| 5,578,439 | 11/1996 | Inagaki . | |
| 5,604,089 | 2/1997 | Ikegawa et al. | 430/584 |

FOREIGN PATENT DOCUMENTS

| | | |
|---|---|---|
| 599 384 A1 | 11/1993 | European Pat. Off. . |
| 0 902 321 A1 | 9/1998 | European Pat. Off. . |

OTHER PUBLICATIONS

STIC–Librairy Report, RN178496–11–2; RN–178040–60–3; RN–158259–41–7, pp. 1–2, 9–10, 12, 22.

*Primary Examiner*—Thorl Chea
*Attorney, Agent, or Firm*—Edith A. Rice

[57] ABSTRACT

This invention relates to a silver halide photographic material comprising at least one silver halide emulsion having associated therewith at least one dye of Formula I

I wherein:

W and W' represent independently an O atom, a S atom, a Se atom or a NR' group wherein R' is a substituted or unsubstituted alkyl group, $Z_1$ represents a substituted or unsubstituted aromatic group, $Z_1$' independently represents a fused aromatic group or a substituted or unsubstituted aromatic group which may be appended directly to the dye or $Z_1$' represents $LZ_2$ where L represents a linking group and $Z_2$ represents a substituted or unsubstituted aromatic group or substituted or unsubstituted alkyl group, $L_1$, $L_2$, and $L_3$ independently represent methine groups bearing a hydrogen, substituted or unsubstituted alkyl group, or a halogen atom, n represents 0 or 1, the benzene rings shown can be further substituted or unsubstituted, $R_1$ and $R_2$ are both substituted or unsubstituted alkyl groups, $R_3$ is hydrogen or a substituted or unsubstituted alkyl group, X is one or more ions as needed to balance the charge on the molecule.

15 Claims, 3 Drawing Sheets

PHOTOGRAPHIC MATERIAL HAVING IMPROVED COLOR REPRODUCTION

FIELD OF THE INVENTION

This invention relates to silver halide photographic material containing at least one silver halide emulsion which has improved color reproduction.

BACKGROUND OF THE INVENTION

A multicolor photographic material typically comprises a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler. One of the challenges of preparing photographic materials is to have each of the red, green, and blue sensitive emulsions absorb light as close as possible to the wavelength of light sensitivity of the human eye in that color range of the spectrum.

The human eye is most sensitive to green light. Thus the green light sensitive layer of photographic materials can have a large impact on perceived color reproduction. This layer is generally sensitive to light within the wavelength region of 500 to 600 nm. In photographic materials, it is common practice to sensitize this layer with a sensitizing dye that has a maximum sensitivity at about 550 nm. However, the human eye has a peak sensitivity at about 540 nm, and still has substantial sensitivity at 500 nm. Efficient sensitizing dyes in the region of 500 to 540 nm would enable more accurate color reproduction for color negative films.

Benzimidazolooxacarbocyanines can provide spectral sensitivity in the region of 520 to 540 nm. However, emulsions containing dyes of this type are known to readily give fog when subjected to heat. They are also known to have poor keeping properties resulting in a loss in sensitivity with time. Also with this dye class, in order to achieve a J-aggregate that absorbs light at a short green wavelength, it is necessary to make the chromophore very unsymmetrical with respect to the charge distribution. This results in a dye with a low extinction coefficient and lowered light absorption per unit dye.

Oxacarbocyanines are another class of dyes that afford efficient J-aggregate sensitization in the green region. Emulsions sensitized with oxacarbocyanines generally do not give fog upon heating and have excellent keeping properties. However, in general, emulsions sensitized with oxacarbocyanines dyes have a maximum sensitivity at 545 nm or greater.

Ikegawa et. al. (U.S. Pat. No. 5,198,332, U.S. Pat. No. 4,970,141, and U.S. Pat. No. 4,889,796) and Nakamura et. al. (U.S. Pat. No. 5,637,448) describe oxacarbocyanine dyes that provide spectral sensitivity below 545 nm. U.S. Pat. No. 5,523,203 describes another class of short green sensitizers. Parton et. al., in U.S. Pat. No. 5,316,904, describe amide-substituted oxacarbocyanine dyes as affording reduced post-process dye stain. However, dyes that give further improvements in spectral sensitivity in the wavelength region of 525 to 535 nm are still needed to improve color reproduction with high sensitivity.

The red sensitivity of the human eye peaks at approximately 590 nm. However, the red wavelength region, 600 to 700 nm, in many photographic products, for example color negative films, has been often sensitized with a dye that has its maximum sensitivity at about 650 nm. A change in the red spectral sensitization from a maximum at 650 nm to a position closer to 600 nm, for example in the 620 to 640 nm region, has several advantages. This could improve the sensitivity of the film color balance to changes in illuminant, especially fluorescent light. Also, some colors that are difficult to reproduce because of high infrared reflectance, would be reproduced more accurately. Thus dyes that have a maximum sensitivity in the short red region, 620 nm–640 nm are desirable.

In many photographic products, for example color negative films, the blue spectral region, 400–500 nm, has been often sensitized with a dye that has its maximum sensitivity at about 470 nm while the eye sensitivity has a peak at approximately 440 nm, and fluorescent lights have a peak emission at 435 nm. A broader blue sensitization envelope could improve the sensitivity of the film color balance to changes in illuminant, especially fluorescent light. This type of spectral envelope can be obtained by combining a dye that has a maximum sensitization at 470 nm with a dye that has a maximum peak at a shorter wavelength. Thus substituents that cause a blue sensitizing dye to aggregate at a shorter wavelength, for example 400–460 nm are desirable.

PROBLEM TO BE SOLVED BY THE INVENTION

As discussed above, there exists a need for sensitizing a silver halide emulsions to green, red or blue light such that the maximum sensitivity of the emulsions is closer to the natural sensitivity of the human eye than is conventionally used in photographic materials. In each case, the maximum sensitivity of conventional silver halide emulsions is at a longer wavelength than the maximum sensitivity of the human eye. Therefore the problem to be solved by this invention is to provide sensitizing dyes which can be used to sensitize silver halide emulsions in the relevant region of the spectrum such that the maximum sensitivity of the emulsions is closer to the sensitivity of the human eye.

SUMMARY OF THE INVENTION

We have found that certain substituents can shift the maximum absorption wavelength of the J-aggregate of certain sensitizing dyes to shorter wavelength (for a discussion of J-aggregation see *The Theory of the Photographic Process,* $4^{th}$ edition, T. H. James, editor, Macmillan Publishing Co., New York, 1977). The dyes used in accordance with the invention can afford improved color reproduction.

For example, it has been found that certain amide substituted oxacarbocyanine dyes efficiently J-aggregate in the short green wavelength region of 525–535 nm and are very efficient sensitizers. These dyes offer the possibility of improving color reproduction and illuminant sensitivity, for example when used in color negative films, by enhancing short green sensitivity. Very few known dyes aggregate and sensitize in this region. Dyes known previously to sensitize in the short green wavelength region, in general, either have poor keeping stability, are not efficient sensitizers, do not form desirable J-aggregates or are difficult to synthesize.

Similarly, such amide substituents can also provide red sensitizing dyes which J-aggregate in the short red region of 590–640 nm and blue sensitizing dyes which J-aggregate in the region of less than 470 nm, preferably 400–460 nm.

Particularly preferred dyes for use in the invention are described by Formula I

I

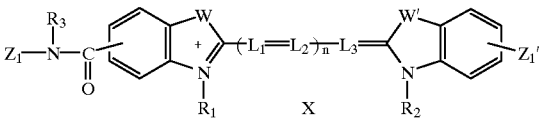

wherein:

W and W' represent independently an O atom, a S atom, a Se atom or a NR' group wherein R' is a substituted or unsubstituted alkyl group, $Z_1$ represents a substituted or unsubstituted aromatic group, $Z_1'$ independently represents a fused aromatic group or a substituted or unsubstituted aromatic group which may be appended directly to the dye or $Z_1'$ represents $LZ_2$ where L represents a linking group and $Z_2$ represents a substituted or unsubstituted aromatic group or substituted or unsubstituted alkyl group, $L_1$, $L_2$, and $L_3$ independently represent methine groups bearing a hydrogen, substituted or unsubstituted alkyl group, or a halogen atom, n represents 0 or 1, the benzene rings shown can be further substituted or unsubstituted, $R_1$ and $R_2$ are both substituted or unsubstituted alkyl groups, $R_3$ is hydrogen or a substituted or unsubstituted alkyl group, X is one or more ions as needed to balance the charge on the molecule.

ADVANTAGEOUS EFFECT OF THE INVENTION

The dyes for use in the invention are easily synthesized. They provide efficient sensitization. The invention dyes aggregate at a shorter wavelength relative to comparison dyes and can afford improved color reproduction.

DETAILED DESCRIPTION OF THE INVENTION

Figure 1:
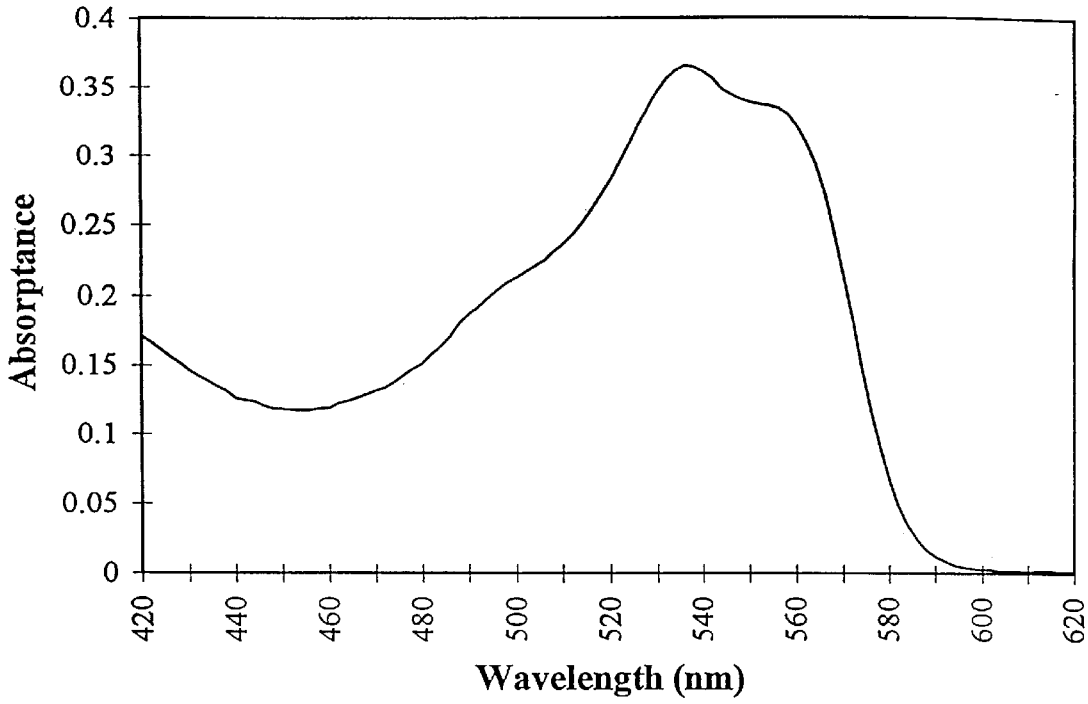
FIGS. 1 through 5 show spectral absorption data for dyes useful in the invention (FIGS. 1–2) and comparative dyes (FIGS. 3–5), as discussed more fully below.

In formula I above, W and W' represent independently an O atom, a S atom, a Se atom or a NR' group wherein R' is a substituted or unsubstituted alkyl group such as methyl, ethyl, chloroethyl, etc.

$Z_1$ represents a substituted or unsubstituted aromatic group. The definition of aromatic rings is described in J. March, *Advanced Organic Chemistry*, Chapter 2, (1985), John Wiley & Sons, New York. The aromatic group can be a hydrocarbon or heterocyclic. Examples of $Z_1$ include a substituted or unsubstituted phenyl group, substituted or unsubstituted thiophene-3-yl group, etc.

$Z_1'$ independently represents a fused aromatic group or a substituted or unsubstituted aromatic group which may be appended directly to the dye or $Z_1'$ may represent $LZ_2$ where L represents a linking group. Preferably the atoms of the linking group are $sp^2$ hybridized. Hybridization is described in J. March, *Advanced Organic Chemistry*, Chapter 1, (1985), John Wiley & Sons, New York. The linking group can be substituted or unsubstituted. Examples of linking groups are —CONR"— or —NR"CO—, wherein R" represents hydrogen or lower alkyl. $Z_2$ represents a substituted or unsubstituted aromatic group or a substituted or unsubstituted alkyl.

The benzene rings shown in Formula I may each be further substituted or not further substituted. For example, either may have 0, 1 or 2 further substituents. Substituents may, for example, independently be, 1 to 18 carbon alkyl (or 1 to 6, or 1 to 2 carbon alkyl), aryl (such as 6 to 20 carbon atoms), heteroaryl (such as pyrrolo, furyl or thienyl), aryloxy (such as 6 to 20 carbon atoms) alkoxy (such as 1 to 6 or 1 to 2 carbon alkoxy), cyano, or halogen (for example F or Cl), an acylamino group, a carbamoyl group, a carboxy group. Such substituents on the benzene rings can also include a ring fused thereto, such as a benzo, pyrrolo, furyl or thienyl ring. Any of the alkyl and alkoxy substituents may have from 1 to 5 (or 1 to 2) intervening oxygen, sulfur or nitrogen atoms.

$L_1$, $L_2$, and $L_3$ independently represent methine groups bearing a hydrogen, substituted or unsubstituted alkyl group,such as methyl, ethyl, etc. or a halogen atom such as chloro atom.

n represents either 0 or 1.

Preferably, $R_1$ and $R_2$ are both substituted or unsubstituted alkyl groups, for example both may be 1–8 carbon alkyl groups, and may be the same or different. At least one of $R_1$ or $R_2$ is preferably substituted by an acid or acid salt group and preferably both $R_1$ and $R_2$ may be substituted by an acid or acid salt group. Acid salt groups include carboxy, sulfo, phosphato, phosphono, sulfonamido, sulfamoyl, or acylsulfonamido (groups such as $—CH_2—CO—NH—SO_2—CH_3$) groups. Note that reference to acid or acid salt groups are used to define only the free acid groups or their corresponding salts, and do not include esters where there is no ionizable or ionized proton. Particularly preferred are the carboxy and sulfo groups (for example, 3-sulfobutyl, 4-sulfobutyl, 3-sulfopropyl, 2-sulfoethyl, carboxymethyl, carboxyethyl, carboxypropyl and the like).

$R_3$ is hydrogen or a substituted or unsubstituted alkyl group such as methyl group.

X is one or more ions as needed to balance the charge on the molecule. Since $R_1$ and $R_2$ are preferably both substituted by an acid or acid salt group, X will typically be a cation. Examples of suitable cations include sodium, potassium and triethylammonium.

Particularly preferred dyes for use in the invention are described by Formula IIa, IIb, and IIc.

IIa

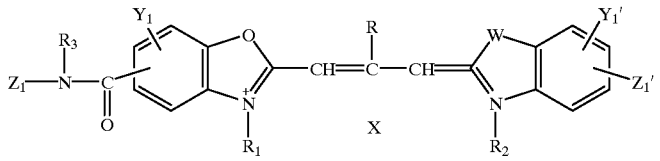

IIb

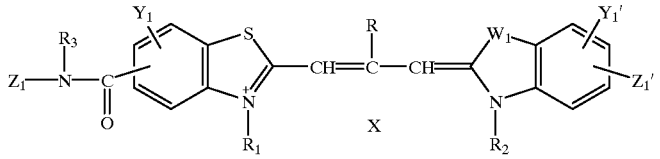

IIc

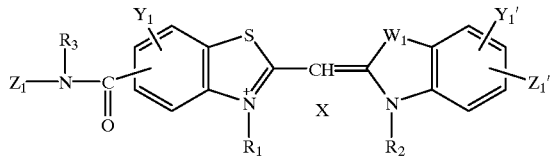

wherein $Z_1$, $Z_1'$, $R_1$, $R_2$, $R_3$ and X are defined above for Formula I, W is a O atom or a NR' group wherein R' is a substituted or unsubstituted alkyl group, $W_1$ is a S, Se or a O atom, $Y_1$ and $Y_1'$ independently represent hydrogen, substituted or unsubstituted alkyl group, a substituted or unsubstituted aromatic group, a halogen atom, a cyano group, an acylamino group, a carbamoyl group, a carboxy group, or a substituted or alkoxy group, R is H or a substituted or unsubstituted aryl (e.g. phenyl) or more preferably a substituted or unsubstituted lower alkyl group (e.g. methyl, ethyl).

More preferred dyes for use in the invention are described by Formula III, IV, and V wherein $W_2$ is a O, S or Se atom and W, $Z_1$, $Z_1'$, R, $R_1$, $R_2$, $R_3$, and X are defined above.

Even more preferred dyes for use in the invention are described by Formula IIa, IIb, and IIc, wherein W is O, $W_1$ is S, $Z_1'$ is represented by $CONR_3Z_1$ and $R_2$ and $R_1$ represent the same group, wherein $Z_1$ and $R_1$ are as defined above. In this case the dyes are symmetrical and this allows the dyes to be more easily synthesized.

Substituents on any of the specified groups defined above that can be substituted (including any of those substituents described for $Z_1$ or $Z_1'$), can include substituents such as halogen (for example, chloro, fluoro, bromo), alkoxy (particularly 1 to 10 carbon atoms; for example, methoxy, ethoxy), substituted or unsubstituted alkyl (particularly of 1 to 10 carbon atoms, for example, methyl, trifluoromethyl), amido or carbamoyl (particularly of 1 to 10 or 1 to 6 carbon

III

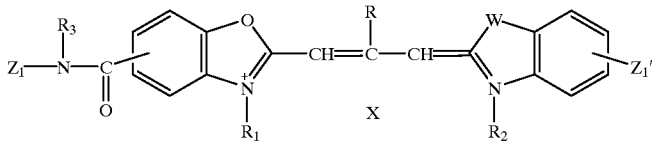

IV

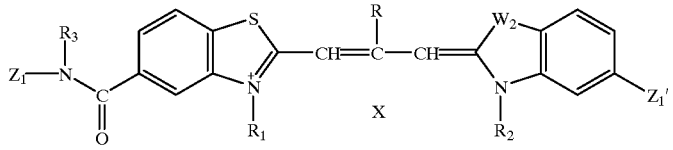

V

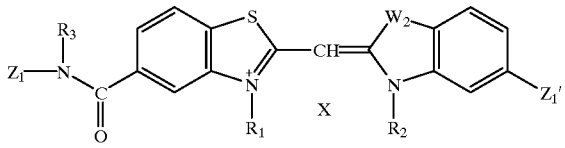

atoms), alkoxycarbonyl (particularly of 1 to 10 or 1 to 6 carbon atoms), and other known substituents, and substituted and unsubstituted aryl ((particularly of 1 to 10 or 1 to 6 carbon atoms) for example, phenyl, 5-chlorophenyl), thioalkyl (for example, methylthio or ethylthio), hydroxy or alkenyl (particularly of 1 to 10 or 1 to 6 carbon atoms) and others known in the art.

Specific examples of sensitizing dyes represented by formula I are shown below, however the sensitizing dyes useful in the invention are not limited to these compounds.

I-1

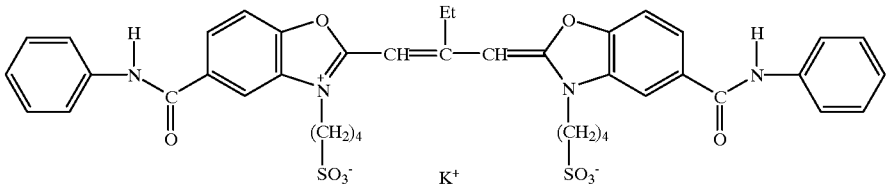

I-2

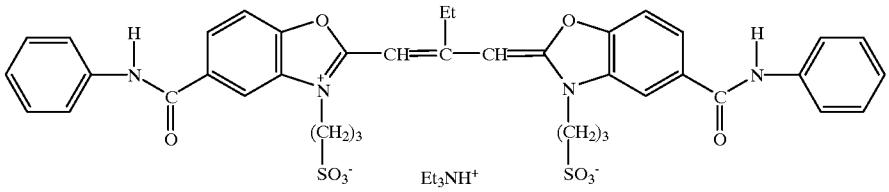

I-3

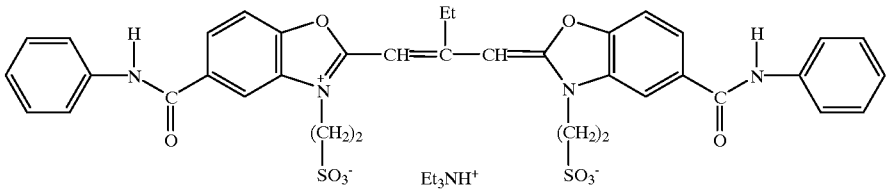

I-4

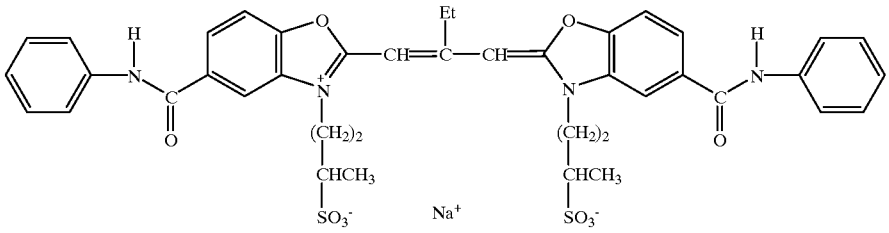

I-5

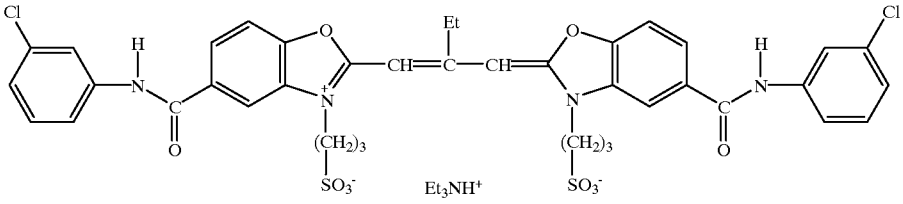

I-6

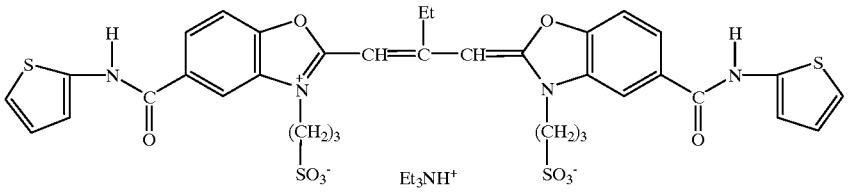

-continued
I-7
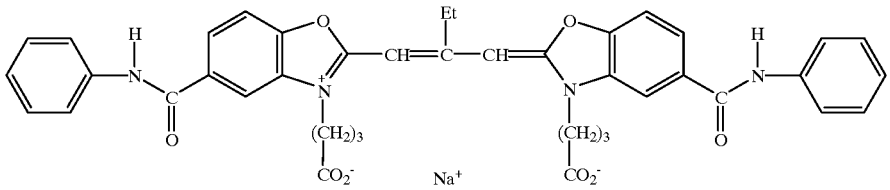
I-8
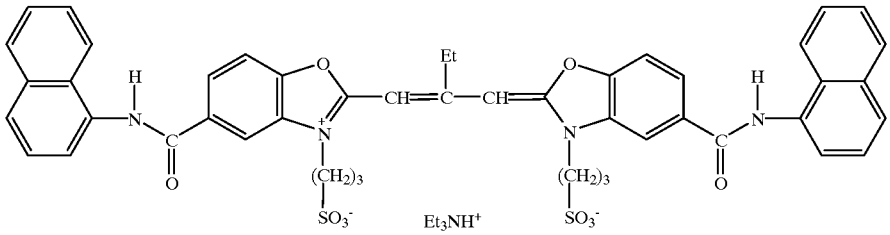
I-9
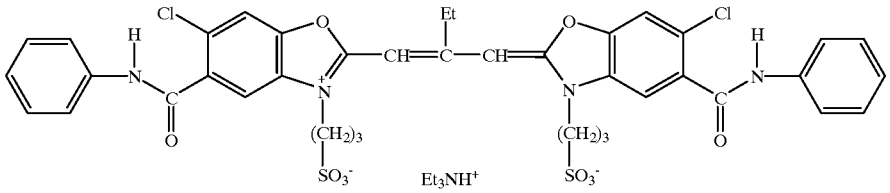
I-10
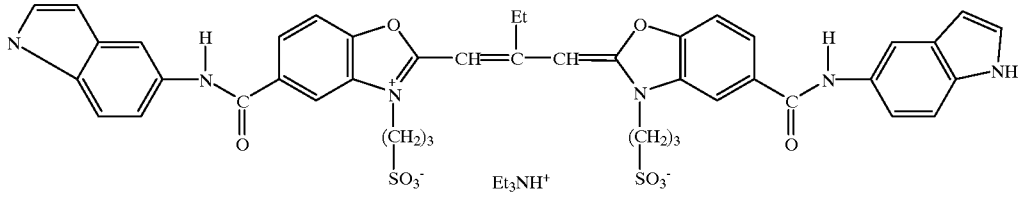
I-11
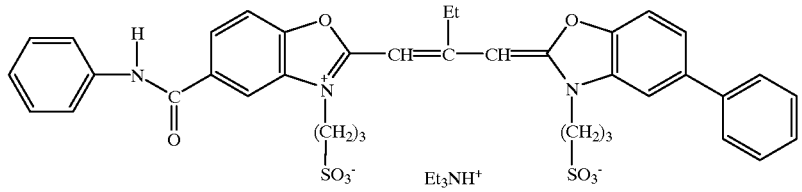
I-12
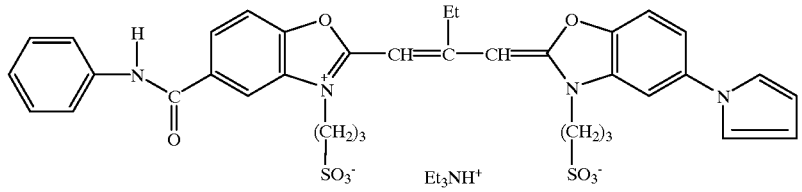
I-13
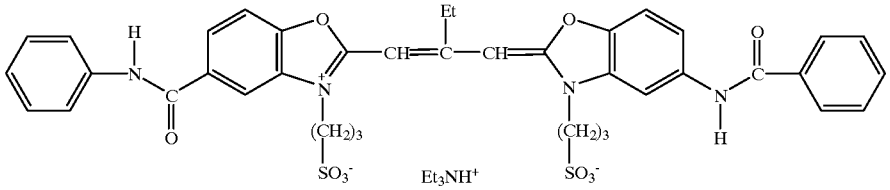

-continued
I-14
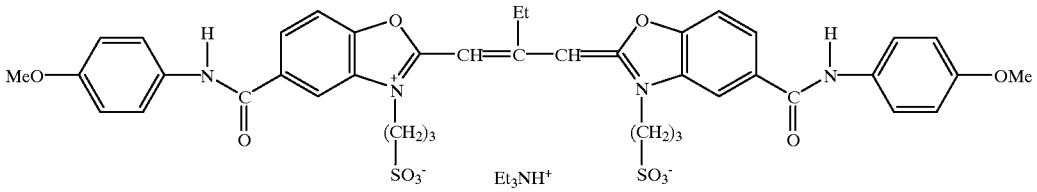
I-15
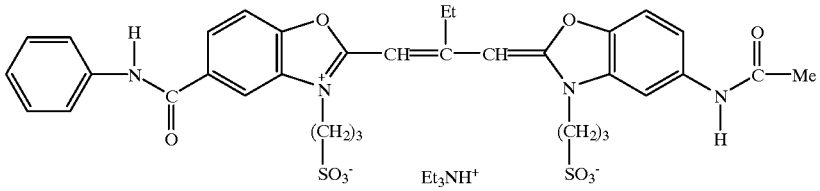
I-16
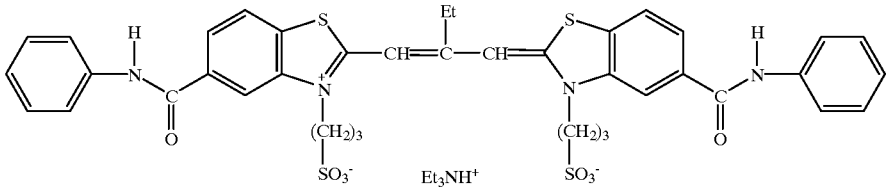
I-17
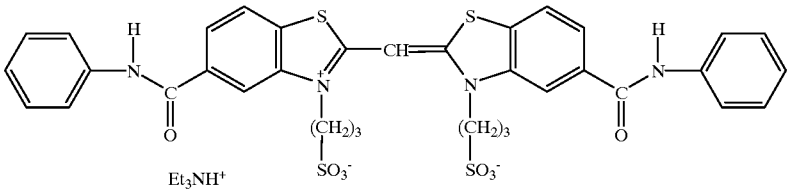
I-18
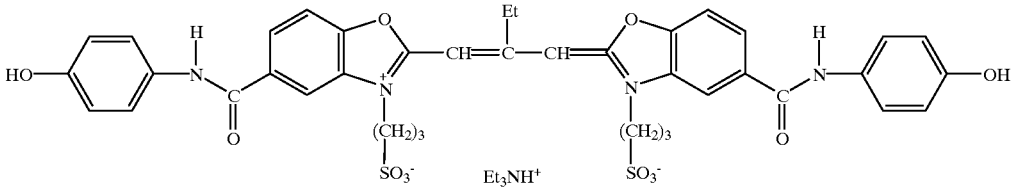
I-19
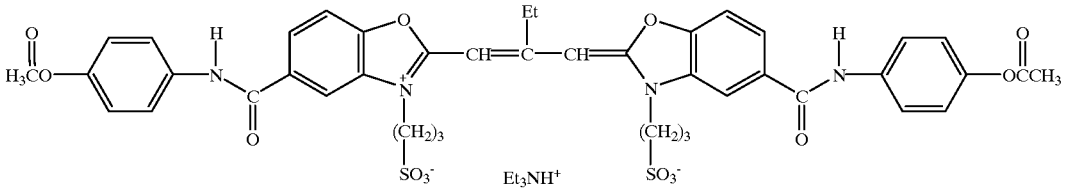
I-20
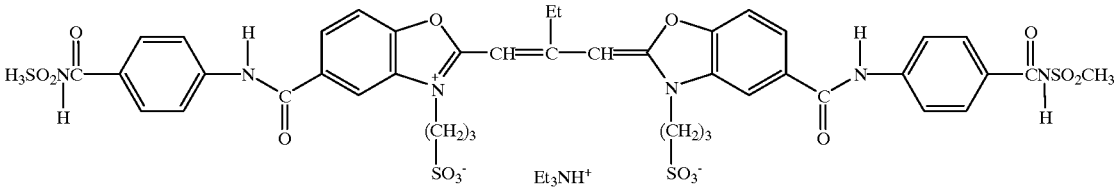

-continued
I-21
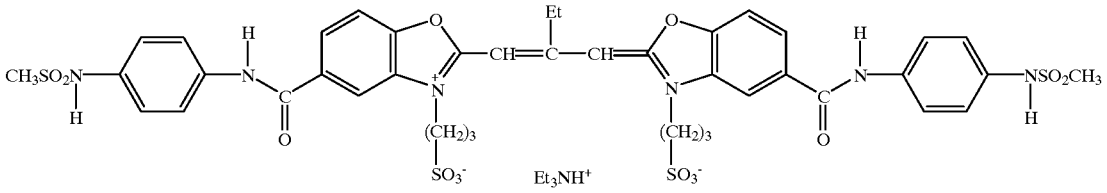
I-22
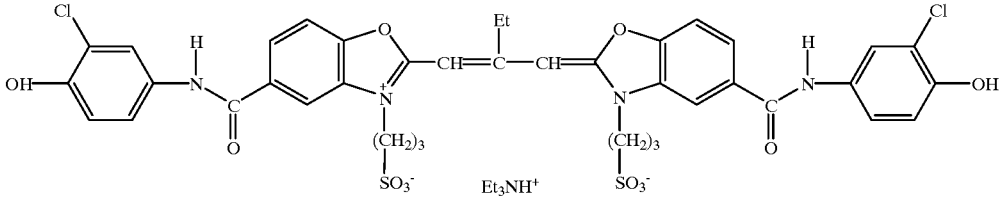
I-23
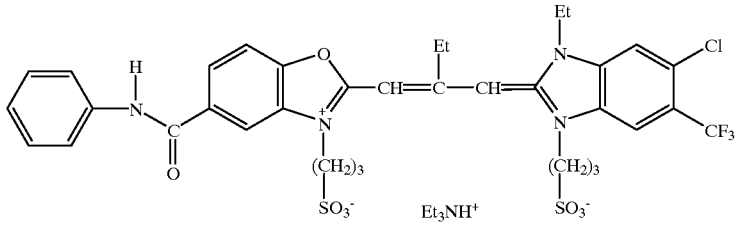
I-24
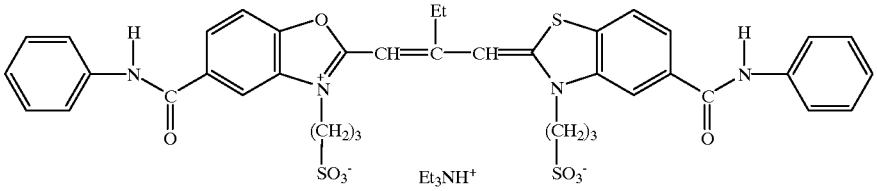
I-25
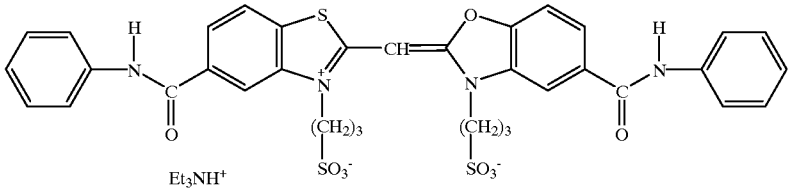
I-26
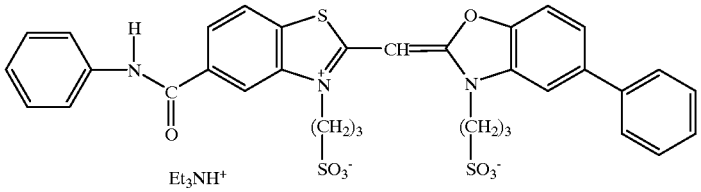
I-27
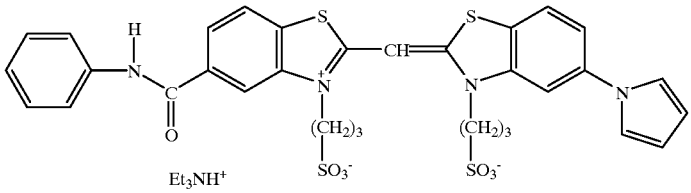

The sensitizing dyes used in the invention can be synthesized by one skilled in the art by known methods, for example procedures described in F. M. Hamer, *Cyanine Dyes and Related Compounds,* 1964 (publisher John Wiley & Sons, New York, N.Y.) and *The Theory of the Photographic Process,* 4th edition, T. H. James, editor, Macmillan Publishing Co., New York, 1977. Synthetic examples are given below.

Example of Dye Synthesis (Synthesis of I-1)

5-Carboxy-2-methylbenzoxazole (2.0 g, 1.1 mmol) and phosphorous oxychloride (10 mL) were combined and heated at 100° C. for 1 hr. The reaction mixture was evaporated and the resulting oil was dissolved in 20 mL of acetonitrile and poured into a mixture of ice and water. The solid formed was collected, dissolved in 40 mL of acetonitrile and combined with aniline (2.0 g, 2.2 mmol). After stirring 45 min. the reaction mixture was poured into 500 mL of a mixture of ice and water. The resulting solid was collected and dried affording 1.65 g (58% yield) of 5-(Phenylcarbamoyl)-2-methylbenzoxazole, mp 137.5–139.0° C. Anal. Calcd for $C_{15}H_{12}N_2O_2$: C, 71.42; H, 4.79; N, 11.10. Found: C, 71.16; H, 4.83; N, 10.96.

5-(Phenylcarbamoyl)-2-methylbenzoxazole (1.0 g, 4.0 mmol) was combined with 1,4-butanesultone (3.0 mL, 29 mmol) and heated at 150° C. for 1 hr. The solid formed was collected and washed with acetone and dried affording 1.2 g of anhydro-5-(phenylcarbamoyl)-2-methyl-3-(4-sulfobutyl) benzoxazolium hydroxide, 75% yield. Anal. Calcd for $C_{19}H_{20}N_2SO_5$: C, 58.75; H, 5.19; N, 7.21. Found: C, 58.26; H, 5.07; N, 6.97.

Anhydro-5-(phenylcarbamoyl)-2-methyl-3-(4-sulfobutyl) benzoxazolium hydroxide (2.0 g, 5.2 mmol), triethylorthopropionate (1.0 g, 5.7 mmol), and 10 mL of m-cresol were combined and heated to 115° C. Triethylamine (2 mL) was added and after stirring 5 min. the reaction mixture was cooled in an ice bath. The product was precipitated with ethyl ether. After washing with ethyl ether, the product was dissolved in acetonitrile; addition of potassium acetate gave an orange precipitate. The product was collected and recrystallized from methanol to afford 400 mg (18% yield) of dye I-1,)λ-max (10% m-cresol, 90% MeOH) 500 nm, $\epsilon=17.3\times10^4$. Anal. Calcd for $C_{41}H_{41}N_4O_{10}S_2K\text{-}2H_2O$: C, 55.59; H, 5.08; N, 6.32. Found: C, 5.99

The amount of sensitizing dye that is useful in the invention may be from 0.001 to 4 millimoles, but is preferably in the range of 0.01 to 4.0 millimoles per mole of silver halide and more preferably from 0.10 to 4.0 millimoles per mole of silver halide. Optimum dye concentrations can be determined by methods known in the art.

The dyes useful in the invention may be used to sensitize a photographic material. They also may be used in combination with one or more additional sensitizing dyes. For example, the dyes useful in the invention may be used in combination with a sensitizing dye that has a maximum wavelength of sensitization in the region of 540 to 560 nm. In another example, the dyes useful in the invention may be used in combination with a sensitizing dye that has a maximum wavelength in the region of 570 to 590 nm. In another example, the dyes useful in the invention may be used in combination with a sensitizing dye that has a maximum wavelength in the region of 540 to 560 nm and an additional sensitizing dye that has a maximum wavelength of sensitization in the region of 570 to 590 nm.

The silver halide may be sensitized by sensitizing dyes by any method known in the art, such as described in *Research Disclosure*, September 1996, Number 389, Item 38957, which will be identified hereafter by the term "Research Disclosure I." The dyes may, for example, be added as a solution or dispersion in water, alcohol, aqueous gelatin, alcoholic aqueous gelatin, microcrystalline dispersion, etc. Several dyes may be added simultaneously from a common solution or dispersion. The dye/silver halide emulsion may be mixed with a dispersion of color image-forming coupler immediately before coating or in advance of coating.

The emulsion layer of the photographic material of the invention can comprise any one or more of the light sensitive layers of the photographic material. The photographic materials made in accordance with the present invention can be black and white elements, single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the visible spectrum can be disposed as a single segmented layer.

Photographic materials of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic materials of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic material is exposed.

In the following discussion of suitable materials for use in elements of this invention, reference will be made to *Research Disclosure I*." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic materials of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic materials are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic materials of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic materials may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic materials may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic materials may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed. Tabular grain silver halide emulsions may also be used.

Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an area equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit the same silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present.

Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions contemplated within the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 $\mu$m. Most preferably the average thickness of the tabular grains is less than 0.2 $\mu$m. In a specific preferred form the tabular grains are ultrathin—that is, their average thickness is less than 0.07 $\mu$m.

The useful average grain ECD of a tabular grain emulsion can range up to about 15 $\mu$m. Except for a very few high speed applications, the average grain ECD of a tabular grain emulsion is conventionally less than 10 $\mu$m, with the average grain ECD for most tabular grain emulsions being less than 5 $\mu$m.

The average aspect ratio of the tabular grain emulsions can vary widely, since it is quotient of ECD divided grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111 } tabular grain emulsions are specifically contemplated, as illustrated by the following patents herein incorporated by reference:

Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,508;
Ishiguro et al U.S. Pat. No. 4,983,508;
Tufano et al U.S. Pat. No. 4,804,621;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858; and
Chang et al U.S. Pat. No. 5,252,452.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are herein incorporated by reference.

Preferred high chloride tabular grain emulsions are {100} tabular grain emulsions, as illustrated by the following patents, herein incorporated by reference:

Maskasky U.S. Pat. No. 5,264,337;
Maskasky U.S. Pat. No. 5,292,632;
House et al U.S. Pat. No. 5,320,938;
Maskasky U.S. Pat. No. 5,275,930;
Brust et al U.S. Pat. No. 5,314,798;
Chang et al U.S. Pat. No. 5,413,904;
Budz et al U.S. Pat. No. 5,451,490;
Maskasky U.S. Pat. No. 5,607,828;
Chang et al U.S. Pat. No. 5,663,041;
Reed et al U.S. Pat. No. 5,695,922; and
Chang et al U.S. Pat. No. 5,744,297.

Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

High bromide {100} tabular grain emulsions are known, as illustrated by Mignot U.S. Pat. No. 4,386,156 and Gourlaouen et al U.S. Pat. No. 5,726,006, the disclosures of which are herein incorporated by reference. It is, however, generally preferred to employ high bromide tabular grain emulsions in the form of {111} tabular grain emulsions, as illustrated by the following patents, herein incorporated by reference:

Kofron et al U.S. Pat. No. 4,439,520;
Wilgus et al U.S. Pat. No. 4,434,226;
Solberg et al U.S. Pat. No. 4,433,048;
Maskasky U.S. Pat. No. 4,435,501;
Maskasky U.S. Pat. No. 4,463,087;
Daubendiek et al U.S. Pat. No. 4,414,310;
Daubendiek et al U.S. Pat. No. 4,672,027;
Daubendiek et al U.S. Pat. No. 4,693,964;
Maskasky U.S. Pat. No. 4,713,320;
Daubendiek et al U.S. Pat. No. 4,914,014;
Piggin et al U.S. Pat. No. 5,061,616;
Piggin et al U.S. Pat. No. 5,061,609;
Bell et al U.S. Pat. No. 5,132,203;
Antoniades et al U.S. Pat. No. 5,250,403;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,252,453;
Brust U.S. Pat. No. 5,248,587;
Black et al U.S. Pat. No. 5,337,495;
Black et al U.S. Pat. No. 5,219,720;
Delton U.S. Pat. No. 5,310,644;
Chaffee et al U.S. Pat. No. 5,358,840;
Maskasky U.S. Pat. No. 5,411,851;
Maskasky U.S. Pat. No. 5,418,125;
Wen U.S. Pat. No. 5,470,698;
Mignot et al U.S. Pat. No. 5,484,697;
Olm et al U.S. Pat. No. 5,576,172;
Maskasky U.S. Pat. No. 5,492,801;
Daubendiek et al U.S. Pat. No. 5,494,789;
King et al U.S. Pat. No. 5,518,872;
Maskasky U.S. Pat. No. 5,604,085;
Reed et al U.S. Pat. No. 5,604,086;
Eshelman et al U.S. Pat. No. 5,612,175;
Eshelman et al U.S. Pat. No. 5,612,176;
Levy et al U.S. Pat. No. 5,612,177;
Eshelman et al U.S. Pat. No. 5,14,359;
Maskasky U.S. Pat. No. 5,620,840;
Irving et al U.S. Pat. No. 5,667,954;
Maskasky U.S. Pat. No. 5,667,955;
Maskasky U.S. Pat. No. 5,693,459;
Irving et al U.S. Pat. No. 5,695,923;
Reed et al U.S. Pat. No. 5,698,387;
Deaton et al U.S. Pat. No. 5,726,007;
Irving et al U.S. Pat. No. 5,728,515;
Maskasky U.S. Pat. No. 5,733,718; and
Brust U.S. Pat. No. 5,763,151.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is herein incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic material can be further increased by doping the grains with a hexacoordination complex containing a nitrosyl or thionitrosyl ligand (NZ dopants) as disclosed in McDugle et al U.S. Pat. No. 4,933,272, the disclosure of which is herein incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic materials of the present invention, as is typical, provide the silver halide in the form of an emulsion. Photographic emulsions generally include a vehicle for coating the emulsion as a layer of a photographic material. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

Photographic materials of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic materials comprising the composition of the invention can be processed in any of a number of well-known photographic processes utilizing any of a number of well-known processing compositions, described, for example, in *Research Disclosure I*, or in *The Theory of the Photographic Process,* $4^{th}$ edition, T. H. James, editor, Macmillan Publishing Co., New York, 1977. In the case of processing a negative working element, the element is treated with a color developer (that is one which will form the colored image dyes with the color couplers), and then with an oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic materials can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Photographic Evaluation

EXAMPLE 1

Sensitizing dye efficiency on a cubic emulsion was determined by coating a polyester support with a chemically-sensitized 0.2 μm cubic silver bromoiodide (2.6 mol % I) emulsion at 10.8 mg Ag/dm$^2$, hardened gelatin at 73 mg/dm$^2$, and the sensitizing dye (see Table I) at 0.8 mmole/mole Ag. Sensitizing dye efficiency on an octahedral emulsion was determined by coating a polyester support with a chemically-sensitized 0.3 μm bromoiodide (3.1 mol % I) octahedral emulsion at 21.5 mg Ag/dm$^2$, hardened gelatin at 86 mg/dm$^2$, and the sensitizing dye (see Table I) at 0.4 mmole/mole Ag. The elements were given a wedge spectral exposure and processed in X-Omat chemistry (a developer containing hydroquinone and p-methylaminophenol as developing agents).

The photographic speed of the dyes is reported in terms of a sensitizing ratio (SR), which is defined as the speed at λmax (in log E units multiplied by 100) minus the intrinsic speed of the dyed emulsion at 400 nm (in log E units multiplied by 100) plus 200. This measurement of speed allows for comparison while using a uniform chemical sensitization that is not optimized for each sensitizing dye. The wavelength of maximum sensitivity (λmax Sens) was determined from light absorptance measurements of the dyed coatings.

The structures of the comparative dyes in the examples are listed below.

C-1

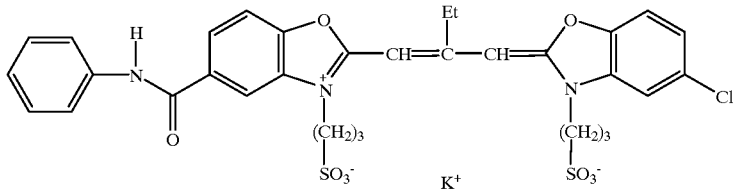

C-2

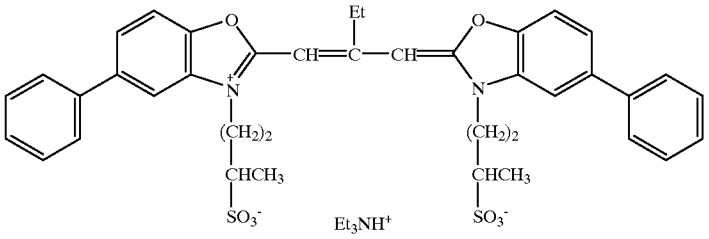

C-3

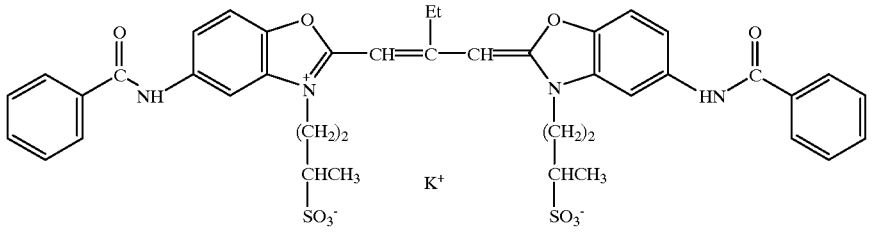

C-4

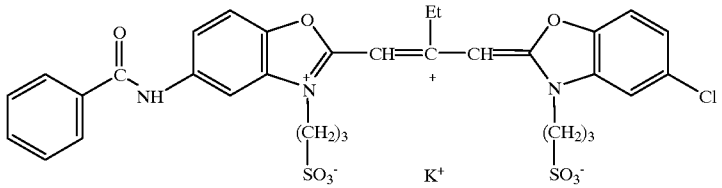

-continued

C-5

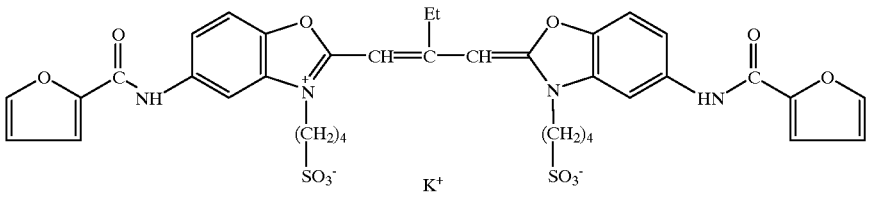

C-6

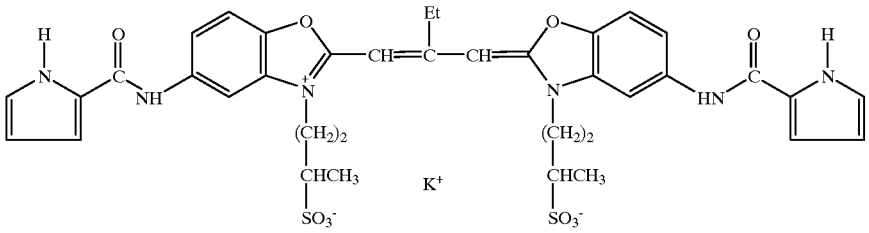

C-7

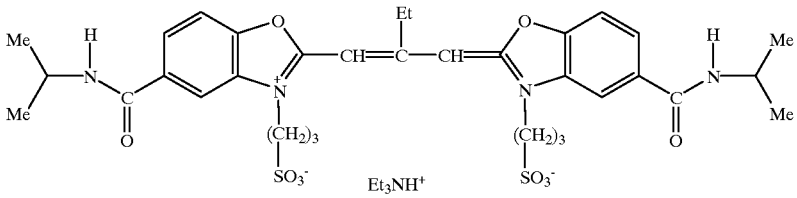

TABLE I

| Example | Dye | Emulsion | λmax Sensitization (nm) | SR | Description |
|---|---|---|---|---|---|
| 101 | I-1 | Cubic | 530 | 243 | Invention |
| 102 | I-2 | Cubic | 532 | 258 | Invention |
| 103 | C-1 | Cubic | 541 | 263 | Comparison |
| 104 | C-2 | Cubic | 545 | 245 | Comparison |
| 105 | C-3 | Cubic | 537 | 239 | Comparison |
| 106 | C-4 | Cubic | 541 | 243 | Comparison |
| 107 | C-5 | Cubic | 545 | 247 | Comparison |
| 108 | C-6 | Cubic | 546 | 251 | Comparison |
| 109 | C-7 | Cubic | 478[1] | 201 | Comparison |
| 110 | I-14 | Octahedral | 526 | 237 | Invention |
| 111 | I-18 | Octahedral | 531 | 224[2] | Invention |
| 112 | C-2 | Octahedral | 543 | 239 | Comparison |

[1]Did not J-aggregate.
[2]Coated at 0.1 mmole/mole Ag

It can be seen From Table I that the dyes useful in the invention give maximum sensitivity in the short green wavelength region. The dyes useful in the invention are very efficient sensitizers.

Photographic Evaluation

EXAMPLE 2

Photographic samples 201 through 219 were prepared. A silver iodobromide tabular grain with an iodide content of 3.8 mole percent, based on silver, was used. The mean equivalent circular diameter of the emulsion was 2.5 μm, the average thickness of the tabular grains was 0.12 μm, and the average aspect ratio of the tabular grains was 20.8. Tabular grains accounted for greater than 90% of the total grain projected area.

The emulsion was sensitized using sodium thiocyanate at 100 mg/mole of silver, 0.90 mmole of spectral sensitizing dye per mole of silver, sodium aurous(I) dithiosulfate dihydrate at 2.2 mg/mole of silver, sodium thiosulfate pentahydrate at 1.1 mg/mole of silver, and 3-(N-methylsulfonyl) carbamoyl-ethylbenzothiazolium tetrafluoroborate at 45 mg/mole of silver. Following the chemical additions the emulsion was subjected to a heat treatment at 62.5° C. for 20 minutes.

The sensitizing dyes used for the spectral sensitization are given in Table II.

A transparent film support of cellulose triacetate with conventional subbing layers was provided for coating. The side of the support to be emulsion coated received an undercoat layer of gelatin of 49 mg/dm$^2$. The reverse side of the support was comprised of dispersed carbon pigment in a non-gelatin binder (Rem Jet).

The coatings were prepared by applying the following layers in the sequence set out below to the support. Bis (vinylsulfonyl)methane was included at the time of the coating at 1.80 percent by weight of total gelatin, including the undercoat, but excluding the previously hardened gelatin subbing layer forming a part of the support. Surfactant was also added to the various layers as is commonly practiced in the art.

| Layer 1: Light-Sensitive Layer | |
|---|---|
| Sensitized Emulsion silver | 10.8 mg/dm$^2$ |
| Cyan dye forming coupler (Coupler-1) | 9.7 mg/dm$^2$ |
| Di-n-butyl phthalate | 9.7 mg/dm$^2$ |
| Gelatin | 32.3 mg/dm$^2$ |
| TAI | 0.17 mg/dm$^2$ |
| **Layer 2: Gelatin Overcoat** | |
| Gelatin | 43.0 mg/dm$^2$ |

-continued

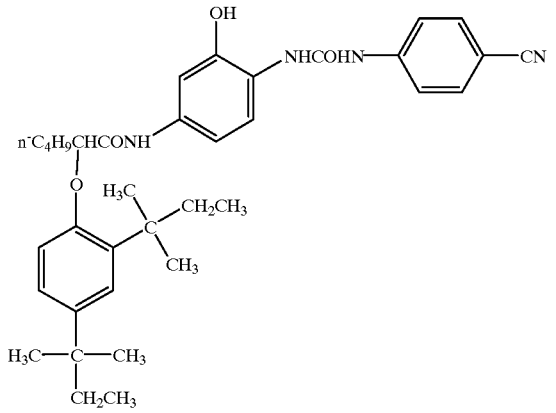

Coupler-1

The dispersed carbon pigment on the back of the coating was removed with methanol. The light transmittance and reflectance of the sample was measured using a spectrophotometer over the visible light range (360 to 700 nanometers) at two nanometer wavelength increments. The total reflectance (R) is the fraction of light reflected from the coating, measured with an integrating sphere which includes all light exiting the coating regardless of angle. The total transmittance (T) is the fraction of light transmitted through the coating regardless of angle. The total absorptance (A) of the coating is determined from the measured total reflectance and total transmittance using the equation $$A=1-T-R.$$

The wavelength of peak light absorption was then determined from the sensitizing dye absorptance data for each coating and the data included in Table II. If multiple peaks were present in the absorptance curve, all peak locations are given, and the peaks are listed in descending absorption order.

All coatings with Rem Jet were exposed through a step wedge for 0.01 second with a 3000 K tungsten light source filtered through a Daylight V and a Kodak Wratten™ 9 filter (transmission at wavelengths longer than 460 nm), and by a 0.30 neutral density filter. The coatings were developed at 38° C. in KODAK Flexicolor C-41™ color negative process, as described by *The British Journal of Photography Annual* of 1988, pp. 196–198, with fresh, unseasoned processing chemical solutions. Another description of the use of the Flexicolor C-41 process is provided by *Using Kodak Flexicolor Chemicals*, Kodak Publication No. Z-131, Eastman Kodak Company, Rochester, NY. Following processing and drying, Samples 201–219 were subjected to Status M densitometry and their sensitometric performance over the visible spectrum was characterized. The photographic speed of each sample was determined by the following method: the speed point was defined as the speed of the point whose density above the minimum density is 20% of the two-point contrast from that point to a point on the densitometric curve with 0.60 logE higher exposure, and the logarithm of the reciprocal of the required exposure in ergs/square centimeter, multiplied by 100, is reported in Table II. This method of determining photographic speed normalizes the speed by the contrast to adjust for differences in curve shape between densitometric curves. The minimum density and the speed of each sample is given Table II.

It can be seen from Table II that the dyes useful in the invention give maximum absorption in the short green wavelength region, and that they are very efficient sensitizers for tabular grain emulsions relative to other dyes which absorb in the short green wavelength region.

TABLE II

| Example | Dye | Wavelength of Maximum Dye Absorption (nm) | Minimum Density | Speed | Description |
|---|---|---|---|---|---|
| 201 | I-1 | 528 | .046 | 263 | Invention |
| 202 | I-2 | 526 | .059 | 274 | Invention |
| 203 | I-18 | 528 | .132 | 267 | Invention |
| 204 | I-19 | 528 | .421 | 269 | Invention |
| 205 | I-14 | 526, 496 | .106 | 275 | Invention |
| 206 | SD-1 | 536 | .082 | 226 | Comparison |
| 207 | SD-2 | 536 | .123 | 270 | Comparison |
| 208 | SD-3 | 540 | .079 | 270 | Comparison |
| 209 | C-7 | 480, 504 | .075 | 227 | Comparison |
| 210 | SD-4 | 468 | .070 | 253 | Comparison |
| 211 | SD-5 | 518 | .041 | 255 | Comparison |
| 212 | SD-6 | 526, 499 | .068 | 275 | Comparison |
| 213 | SD-7 | 492, 518 | .054 | 265 | Comparison |
| 214 | SD-8 | 518 | .057 | 165 | Comparison |
| 215 | SD-9 | 534 | .097 | 282 | Comparison |
| 216 | SD-10 | 538 | .100 | 280 | Comparison |
| 217 | SD-11 | 530, 488 | .102 | 274 | Comparison |
| 218 | SD-12 | 530 | .211 | 251 | Comparison |
| 219 | SD-13 | 536 | .091 | 289 | Comparison |

The structures of comparative dyes in the examples are listed below.

SD-1

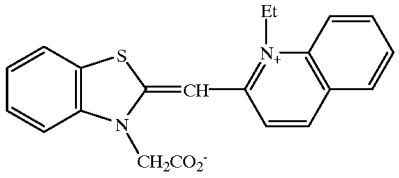

-continued
SD-2
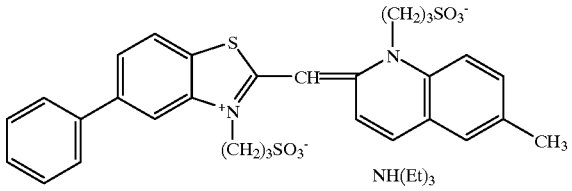
SD-3
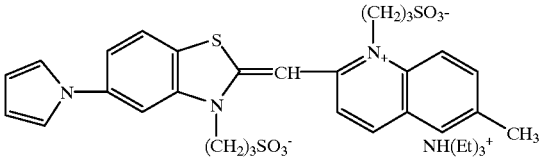
SD-4
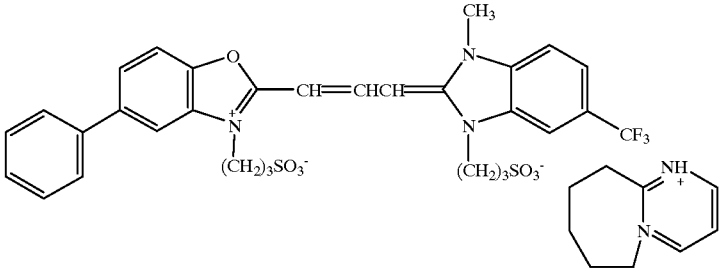
SD-5
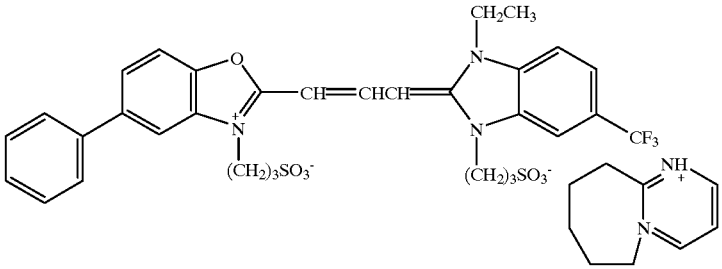
SD-6
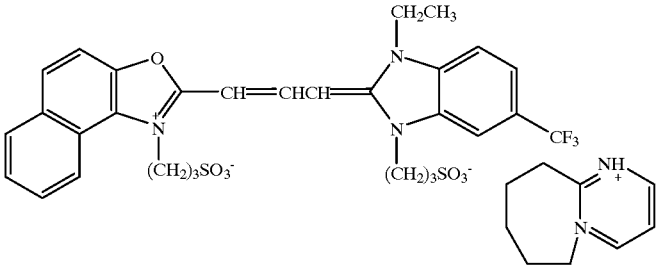
SD-7
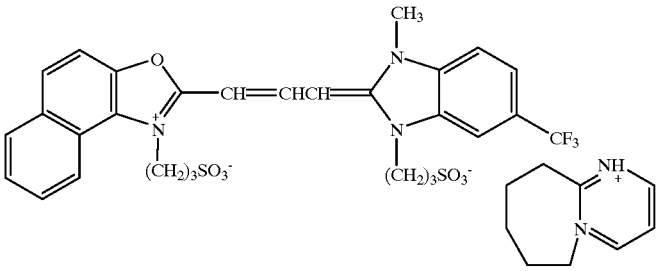

-continued
SD-8
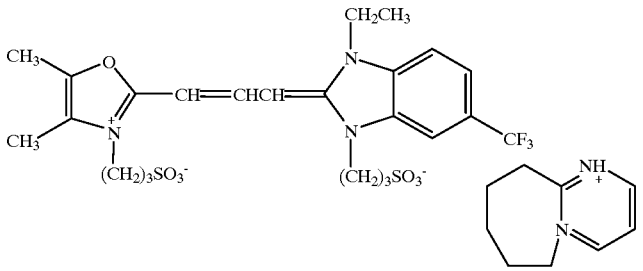
SD-9
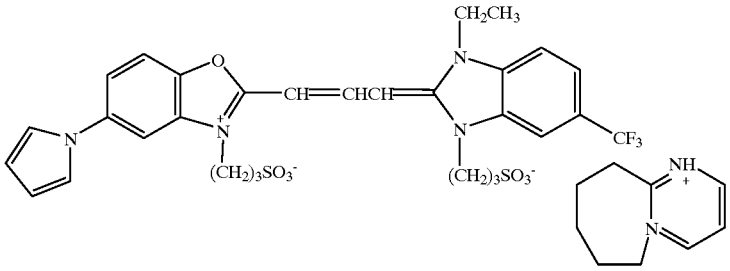
SD-10
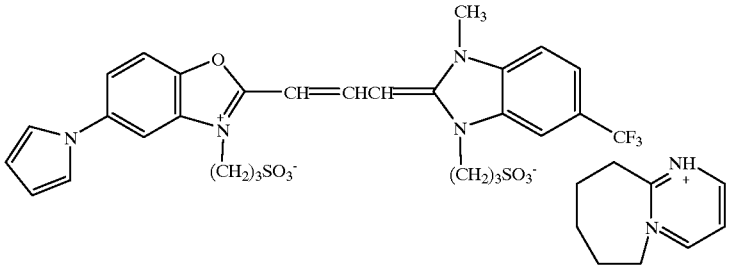
SD-11
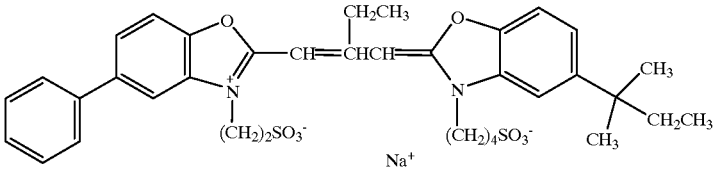
SD-12
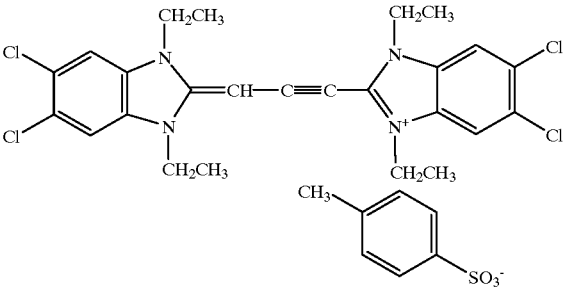
SD-13
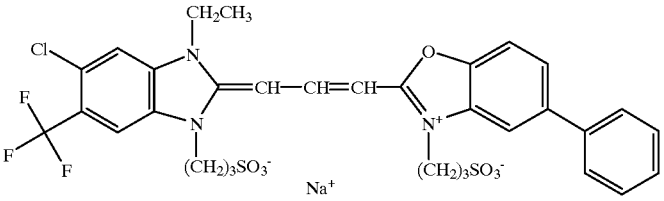

Photographic Evaluation

EXAMPLE 3

Photographic samples 301 through 319 were prepared similar to the samples of example 2. A silver iodobromide tabular grain with an iodide content of 3.8 mole percent, based on silver, was used. The mean equivalent circular diameter of the emulsion was 2.5 μm, the average thickness of the tabular grains was 0.12 μm, and the average aspect ratio of the tabular grains was 20.8. Tabular grains accounted for greater than 90% of the total grain projected area.

The emulsion was sensitized using sodium thiocyanate at 100 mg/mole of silver, 0.90 mmole of spectral sensitizing dye per mole of silver, sodium aurous(I) dithiosulfate dihydrate at 2.2 mg/mole of silver, sodium thiosulfate pentahydrate at 1.1 mg/mole of silver, and 3-(N-methylsulfonyl) carbamoyl-ethylbenzothiazolium tetrafluoroborate at 45 mg/mole of silver. Following the chemical additions the emulsion was subjected to a heat treatment at 62.5° C. for 20 minutes.

The sensitizing dyes used for the spectral sensitization are given in Table III. In each case, the dye listed in Table III was blended with dye SD-14 in a one to one molar ratio in methanol prior to addition to the emulsion. Dye SD-14 on a tabular substrate coated and evaluated as in these examples gives an absorption maximum at 544 nm.

The coatings were prepared as in Example 2, and the wavelength of maximum dye absorption was determined as in Example 2. The coatings were exposed, processed, and the minimum density and speed were also determined as in Example 2.

It can be seen from Table III that the dyes useful in the invention can be blended with another common green sensitizing dye to substantially shorten the wavelength of the second dye. The dye combination provides an efficient sensitization on the tabular grain.

TABLE III

| Example | Dye Blended with SD-14, 1:1 molar ratio | Wavelength of Maximum Dye Absorption (nm) | Minimum Density | Speed | Description |
|---|---|---|---|---|---|
| 301 | I-1 | 535 | .046 | 288 | Invention |
| 302 | I-2 | 532 | .071 | 290 | Invention |
| 303 | I-18 | 538 | .293 | 287 | Invention |
| 304 | I-19 | 544 | .166 | 277 | Invention |
| 305 | I-14 | 532 | .125 | 285 | Invention |
| 306 | SD-1 | 540 | .066 | 276 | Comparison |
| 307 | SD-2 | 542 | .072 | 288 | Comparison |
| 308 | SD-3 | 544 | .059 | 283 | Comparison |
| 309 | C-7 | 542, 505 | .050 | 247 | Comparison |
| 310 | SD-4 | 538 | .066 | 286 | Comparison |
| 311 | SD-5 | 540 | .063 | 290 | Comparison |
| 312 | SD-6 | 544 | .055 | 290 | Comparison |
| 313 | SD-7 | 540 | .054 | 289 | Comparison |
| 314 | SD-8 | 546 | .048 | 226 | Comparison |
| 315 | SD-9 | 542 | .088 | 291 | Comparison |
| 316 | SD-10 | 542 | .109 | 290 | Comparison |
| 317 | SD-11 | 538 | .106 | 286 | Comparison |
| 318 | SD-12 | 540 | .226 | 292 | Comparison |
| 319 | SD-13 | 546 | .152 | 304 | Comparison |

SD-14

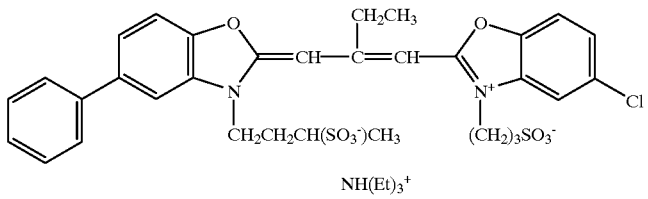

Photographic Evaluation

EXAMPLE 4

Photographic samples 401 through 405 were prepared like the samples of Example 2. The same silver iodobromide tabular grain was used.

In each sample, an inventive or comparison short green dye was combined with SD-14, SD-15, and SD-16 at the ratio given in Table IV. Each dye ratio was selected to provide absorption in the short green and long green region, and with high half-peak bandwidth. Half-peak bandwidth indicates the spectral region over which absorption exhibited by the dye is at least half its absorption at its wavelength of maximum absorption.

Each dye combination was then optimally sensitized for the emulsion, using variations in sensitizing dye level, chemical sensitizer levels, and finish time and temperature levels, as is commonly known in the art. The emulsion was sensitized using sodium thiocyanate at 100 mg/mole of silver, approximately 0.90 mmole of spectral sensitizing dye per mole of silver, sodium aurous(I) dithiosulfate dihydrate, sodium thiosulfate pentahydrate, and 3-(N-methylsulfonyl) carbamoyl-ethylbenzothiazolium tetrafluoroborate. Following the chemical additions the emulsion was subjected to a heat treatment.

The sensitizing dyes and dye ratios used for the spectral sensitization are given in Table IV. In each case, the dyes listed in Table IV were blended in methanol prior to addition to the emulsion.

Figure 2:
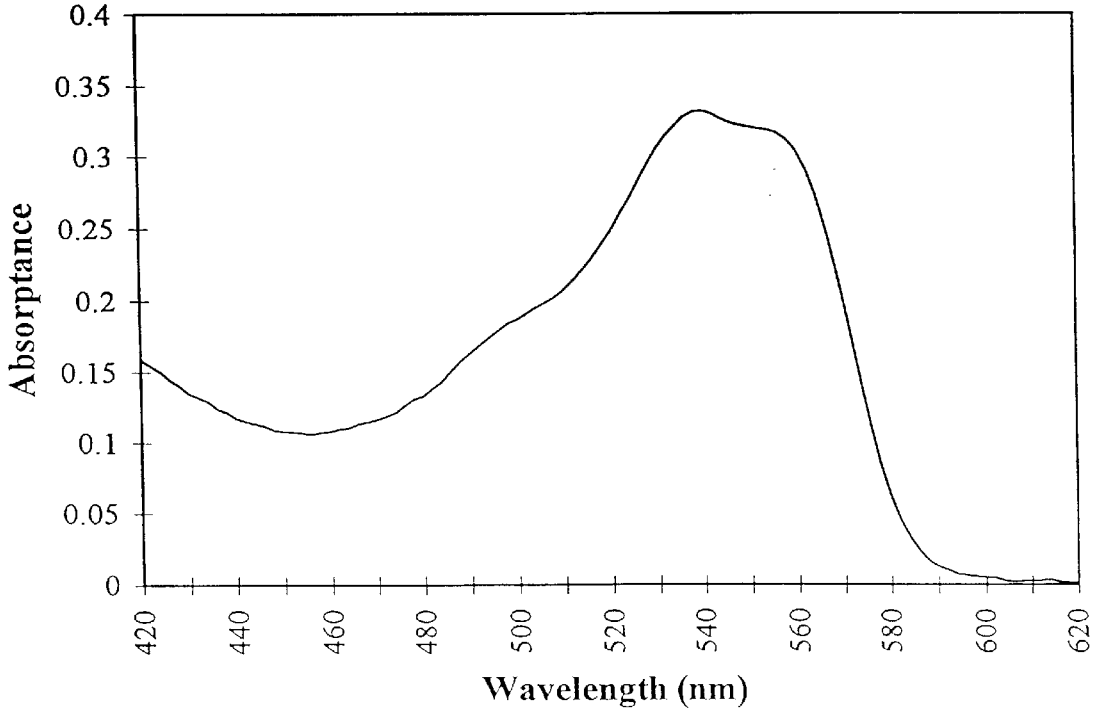
Figure 3:
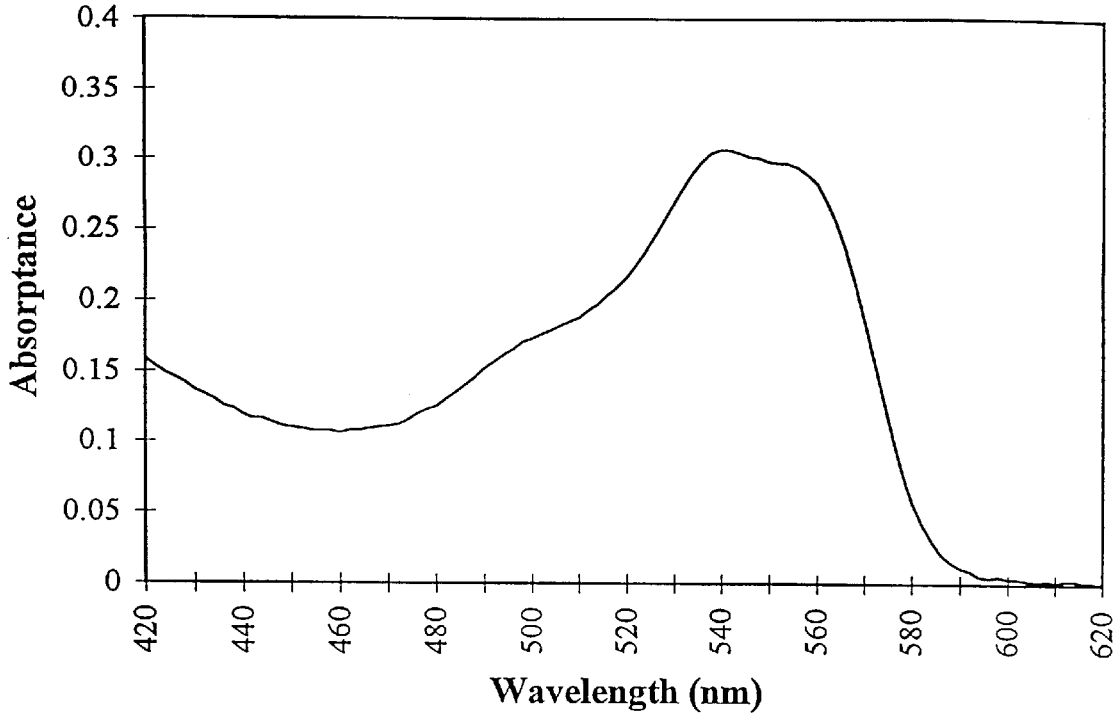
Figure 4:
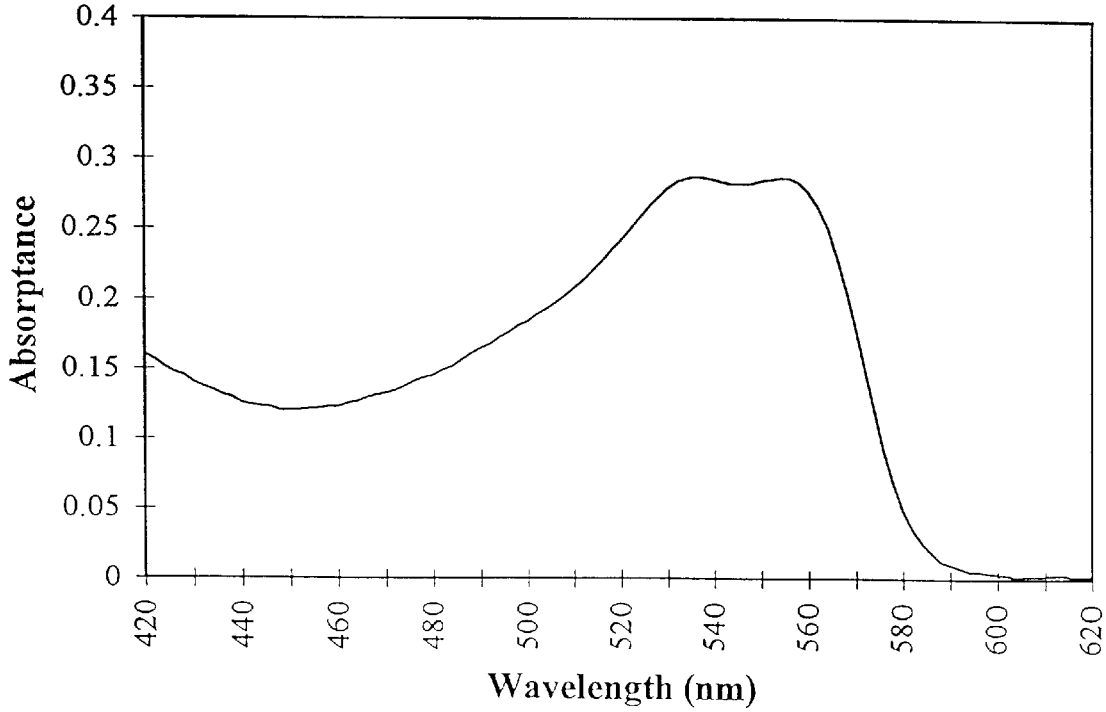
Figure 5:
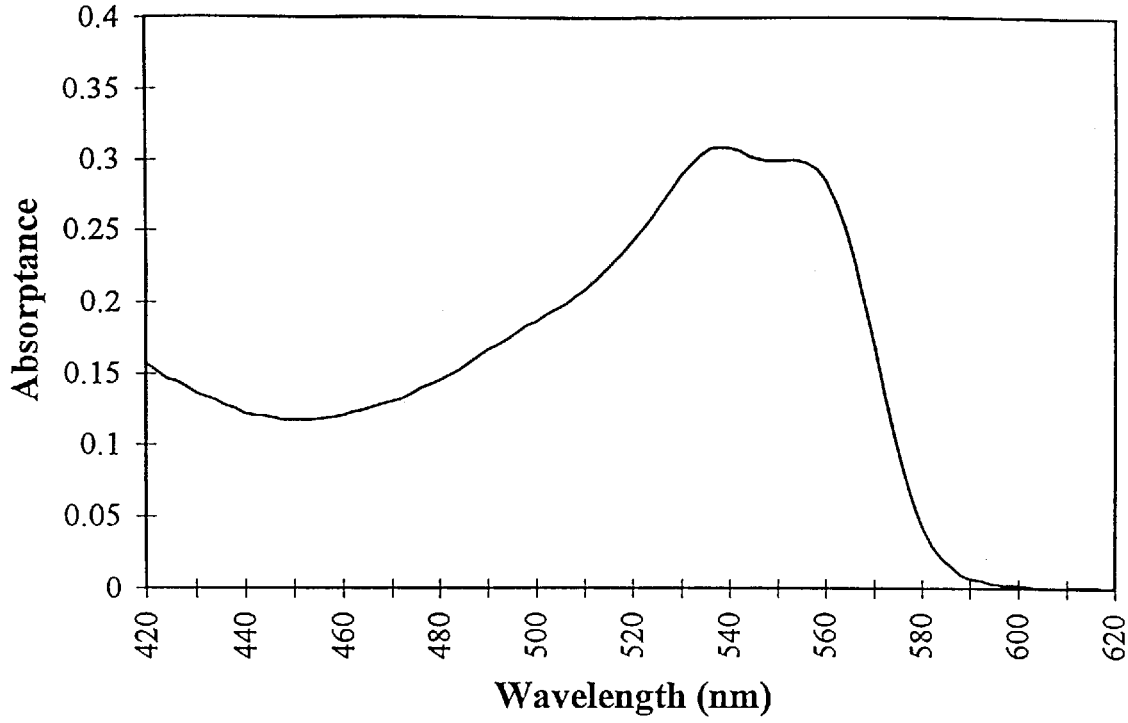

The coatings were prepared as in Example 2, and the absorption data from 420 nm to 620 nm are shown in FIGS. 1 through 5 for samples 401 to 405, respectively. The coatings were exposed, processed, and the minimum density and the speed were also determined as in Example 2.

It can be seen from Table IV and from FIGS. 1 through 5 that the dyes useful in the invention can be blended with other common green sensitizing dyes to provide broad absorption in both the short and long green regions of the visible spectrum. The dye combinations that include a dye of the invention provide the highest speed at nearly matched or lower minimum density. Dyes useful in the invention provide superior efficiency when combined with other green dyes, compared to other dyes which absorb in the short green region that are common in the art. The dyes useful in the invention also offer an advantage in that less of the inventive short green dye is required to achieve the desired broad absorption, 20% of the inventive dyes in samples 401 and 402, compared to 50% in the samples 403–405.

TABLE IV

| Example | Dyes | Molar Dye Ratio Used | Minimum Density | Sped | FIG. Number | Description |
|---|---|---|---|---|---|---|
| 401 | I-1 | 20 | .067 | 309 | 1 | Invention |
| | SD-14 | 50 | | | | |
| | SD-15 | 20 | | | | |
| | SD-16 | 10 | | | | |
| 402 | I-2 | 20 | .118 | 312 | 2 | Invention |
| | SD-14 | 50 | | | | |
| | SD-15 | 20 | | | | |
| | SD-16 | 10 | | | | |
| 403 | SD-5 | 50 | .113 | 307 | 3 | Comparison |
| | SD-14 | 25 | | | | |
| | SD-15 | 15 | | | | |
| | SD-16 | 10 | | | | |
| 404 | SD-2 | 50 | .129 | 306 | 4 | Comparison |
| | SD-14 | 25 | | | | |
| | SD-15 | 15 | | | | |
| | SD-16 | 10 | | | | |
| 405 | SD-10 | 50 | .117 | 308 | 5 | Comparison |
| | SD-14 | 25 | | | | |
| | SD-15 | 15 | | | | |
| | SD-16 | 10 | | | | |

SD-15

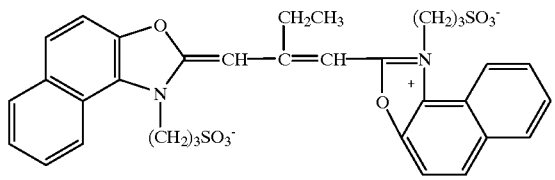

$Na^+$

SD-16

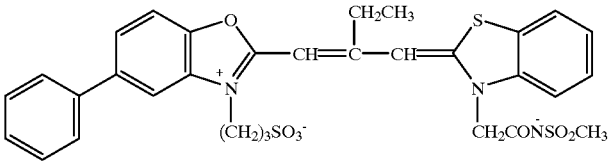

$NEt_3H^+$

Evaluation

EXAMPLE 5

Emulsion samples were prepared by combining $4.16\times10^{-4}$ Ag moles of cubic emulsion (0.2 $\mu$m silver bromoiodide (2.6 mol % I)), 3.8 g of gelatin, and 1 mL of water at 40° C. A solution of dye (1 ml of a 0.25 mg/mL dye solution, see Table V) was added and the melt was stirred for 15 minutes at 40° C. Two coatings were then prepared for each emulsion by placing 6 drops of the melt on a glass microscope slide and spreading the melt using a coating blade that delivers a thickness of 8 microns. The slide coatings were dried overnight in a refrigerator. Two slide coatings for an emulsion were then placed emulsion side together. The light absorption of the dried slides was measured from 350–750 nm using a spectrophotometer which was equipped with an integrating sphere. All the dyes examined formed J-aggregates on the emulsion. Results are reported in Table V.

Samples were also prepared using a 0.3 $\mu$m silver bromoiodide (3.1 mol % I) octahedral emulsion. A melt containing $8.33\times10^{-4}$ Ag moles of octahedral emulsion, 3.8 g of gelatin, and 1.5 mL of water was prepared at 40° C. Slide coatings were prepared and the light absorption of the dried slides was measured as described above.

It can be seen from Table V that the dyes useful in the invention aggregate and absorb light at a significantly shorter wavelength than the comparison dyes on both the cubic and octahedral emulsions.

TABLE V

| Example | Dye | λmax (nm) Cubic Emulsion | λmax (nm) Octahedral Emulsion | Description |
|---|---|---|---|---|
| 501 | I-17 | 456 | 454 | Invention |
| 502 | C-8 | 468 | 468 | Comparison |
| 503 | I-16 | 598 | 597 | Invention |
| 504 | C-9 | 630 | 629 | Comparison |
| 505 | I-24 | 561 | 559 | Invention |
| 506 | C-10 | 588 | 585 | Comparison |
| 507 | I-2 | 531 | 527 | Invention |
| 508 | C-2 | 548 | 546 | Comparison |

C-8

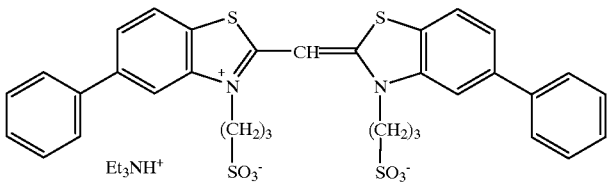

C-9

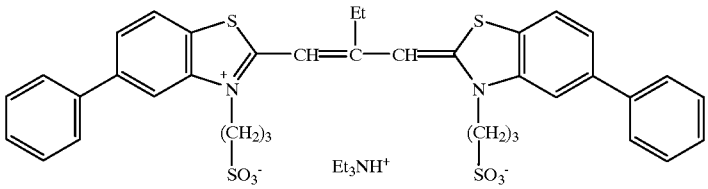

C-10

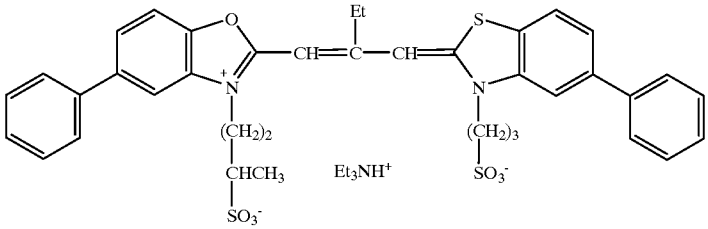

The invention has been described in detail with particular reference to certain preferred embodiments thereof, but it will be understood that variations and modifications can be effected within the spirit and scope of the invention.

What is claimed is:

1. A silver halide photographic material comprising at least one silver halide emulsion having associated therewith at least one dye of Formula I

I

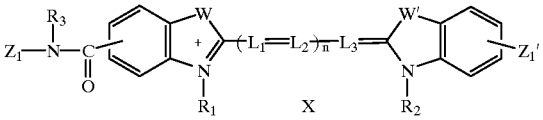

wherein:

W and W' represent independently an O atom, a S atom, a Se atom or a NR' group wherein R' is a substituted or unsubstituted alkyl group, $Z_1$ represents a substituted or unsubstituted aromatic group, $Z_1'$ independently represents a fused aromatic group or a substituted or unsubstituted aromatic group which may be appended directly to the dye or $Z_1'$ represents $LZ_2$ where L represents a linking group and $Z_2$ represents a substituted or unsubstituted aromatic group or substituted or unsubstituted alkyl group, $L_1$, $L_2$, and $L_3$ independently represent methine groups bearing a hydrogen, substituted or unsubstituted alkyl group, or a halogen atom, n represents 0 or 1, the benzene rings shown can be further substituted or unsubstituted, $R_1$ and $R_2$ are both substituted or unsubstituted alkyl groups, $R_3$ is hydrogen or a substituted or unsubstituted alkyl group, X is one or more ions as needed to balance the charge on the molecule.

2. A silver halide photographic material according to claim 1 wherein $R_1$ and $R_2$ represent the same sulfoalkyl group, R is ethyl, $R_3$ represents hydrogen, $Z_1$ represents a substituted or unsubstituted phenyl group and $Z_2$ represents a —$NHCOZ_1$ group.

3. A silver halide photographic material according to claim 1, wherein $Z_1'$ is represented by $CONR_4Z_2$ wherein $R_4$ represents a hydrogen or a substituted or unsubstituted alkyl group and $Z_2$ represents a substituted or unsubstituted aromatic group.

4. A silver halide photographic material according to claim 1, wherein $Z_1'$ is represented by $CONHZ_1$ and $R_3$ is hydrogen.

5. A silver halide photographic material according to claim 1, wherein $Z_1'$ is represented by $CONHZ_1$ and $R_3$ is hydrogen and W and W' are independently either O or S and $R_1$ and $R_2$ are independently alkyl groups substituted with an acid or acid salt group.

6. A silver halide photographic material according to claim 1 comprising at least one silver halide emulsion having associated therewith at least one dye of Formula IIa, IIb, or IIc IIa

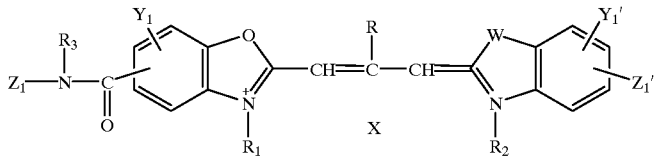

IIb

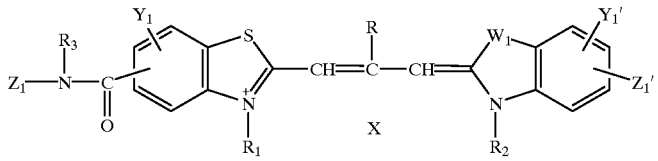

IIc

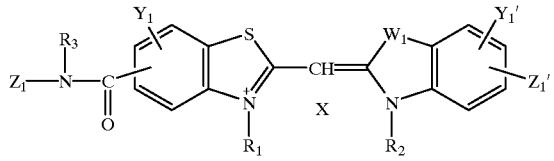

wherein:

W is an O atom or a NR' group wherein R' is a substituted or unsubstituted alkyl group, $W_1$ is a S, Se or O atom, $Y_1$ and $Y_1'$ independently represent hydrogen, substituted or unsubstituted alkyl group, a substituted or unsubstituted aromatic group, a halogen atom, a cyano group, an acylamino group, a carbamoyl group, a carboxy group, or a substituted or unsubstituted alkoxy group, R is H or a substituted or unsubstituted lower alkyl group or a substituted or unsubstituted aryl group, $R_1$ and $R_2$ are both substituted or unsubstituted alkyl groups, $R_3$ is hydrogen or a substituted or unsubstituted alkyl group, X is one or more ions as needed to balance the charge on the molecule.

7. A silver halide photographic material according to claim 1 comprising at least one silver halide emulsion having associated therewith at least one dye of Formula III

III

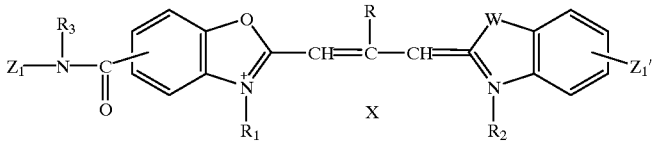

wherein:

W is an O atom or a NR' group wherein R' is a substituted or unsubstituted alkyl group, $Z_1$ represents a substituted or unsubstituted aromatic group, $Z_1'$ independently represents a fused aromatic group or a substituted or unsubstituted aromatic group which may be appended directly to the dye or may be connected by a linking group, $Z_1'$ independently represents a substituted or unsubstituted aromatic group which may be appended directly to the dye or may be connected by a linking group, R is H or a substituted or unsubstituted lower alkyl group or a substituted or unsubstituted aryl group, $R_1$ and $R_2$ are both substituted or unsubstituted alkyl groups, $R_3$ is hydrogen or a substituted or unsubstituted alkyl group, X is one or more ions as needed to balance the charge on the molecule.

8. A silver halide photographic material according to claim 7 wherein W represents an oxygen atom.

9. A silver halide photographic material according to claim 8 wherein at least one of $R_1$ or $R_2$ represents a group that is substituted by an acid or acid salt group and $Z_1'$ is represented by $CONHZ_2$ wherein $Z_2$ independently represents a substituted or unsubstituted aromatic group and R represents a lower alkyl group.

10. A silver halide photographic material according to claim 9 wherein $Z_1'$ is represented by —$CONHZ_1$, R is an ethyl group, and $R_2$ and $R_1$ represent the same group that is substituted by an acid or acid salt group.

11. A silver halide photographic material according to claim 10 wherein $R_3$ is hydrogen and $Z_1$ is a substituted or unsubstituted phenyl group.

12. A photographic material according to claim 1, comprising at least one silver halide emulsion having associated therewith at least one dye of Formula IV:

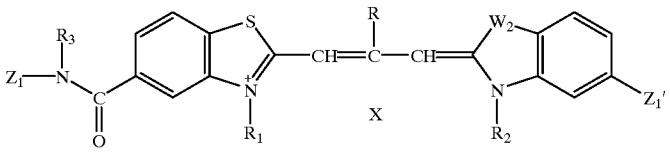

IV wherein $W_2$ is a O, S or Se atom;

$Z_1$ represents a substituted or unsubstituted aromatic group, $Z_1'$ independently represents a substituted or unsubstituted aromatic group which may be appended directly to the dye or $Z_1'$ represents $LZ_2$ where L represents a linking group and $Z_2$ represents a substituted or unsubstituted aromatic group or substituted or unsubstituted alkyl group, $R_1$ and $R_2$ are both substituted or unsubstituted alkyl groups, $R_3$ is hydrogen or a substituted or unsubstituted alkyl group, X is one or more ions as needed to balance the charge on the molecule.

13. A photographic material according to claim 12, wherein $W_2$ is S.

14. A photographic material according to claim 1, comprising at least one silver halide emulsion having associated therewith at least one dye of Formula V:

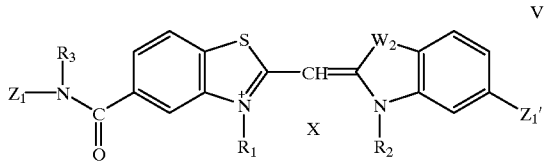

V wherein $W_2$ is a O, S or Se atom;

$Z_1$ represents a substituted or unsubstituted aromatic group, $Z_1'$ independently represents a substituted or unsubstituted aromatic group which may be appended directly to the dye or $Z_1'$ represents $LZ_2$ where L represents a linking group and $Z_2$ represents a substituted or unsubstituted aromatic group or substituted or unsubstituted alkyl group, $R_1$ and $R_2$ are both substituted or unsubstituted alkyl groups, $R_3$ is hydrogen or a substituted or unsubstituted alkyl group, X is one or more ions as needed to balance the charge on the molecule.

15. A photographic material according to claim 14, wherein $W_2$ is S.

* * * * *